US009211703B2

(12) United States Patent
Steinbrenner et al.

(10) Patent No.: US 9,211,703 B2
(45) Date of Patent: Dec. 15, 2015

(54) TEMPERATURE DEPENDENT SHAPE ELEMENTS FOR VOID CONTROL IN INK JET PRINTERS

(71) Applicant: Palo Alto Research Center Incorporated, Palo Alto, CA (US)

(72) Inventors: Julie E. Steinbrenner, Boulder, CO (US); Eric J. Shrader, Belmont, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 288 days.

(21) Appl. No.: 13/714,361

(22) Filed: Dec. 13, 2012

(65) Prior Publication Data

US 2014/0168327 A1 Jun. 19, 2014

(51) Int. Cl.

| | |
|---|---|
| ***B41J 2/175*** | (2006.01) |
| ***B41J 2/055*** | (2006.01) |
| ***B41J 2/14*** | (2006.01) |

(52) U.S. Cl.

CPC ..... *B41J 2/055* (2013.01); *B41J 2/14201* (2013.01); *B41J 2/17593* (2013.01); *B41J 2002/14419* (2013.01)

(58) Field of Classification Search

CPC .... B41J 2/055; B41J 2/14201; B41J 2/17593; B41J 2002/14419

USPC ..... 347/88

See application file for complete search history.

(56) References Cited

U.S. PATENT DOCUMENTS

| | | | | |
|---|---|---|---|---|
| 4,100,904 | A | 7/1978 | Eckert et al. | |
| 4,517,541 | A | 5/1985 | Ubukata et al. | |
| 4,542,391 | A * | 9/1985 | Miyagawa | 347/65 |
| 4,586,653 | A | 5/1986 | Foller et al. | |
| 5,509,390 | A | 4/1996 | Tuckey | |
| 5,518,025 | A | 5/1996 | Futa, Jr. et al. | |
| 5,604,338 | A | 2/1997 | Paxton et al. | |
| 6,588,890 | B1 | 7/2003 | Furlani et al. | |
| 6,764,166 | B2 | 7/2004 | Silverbrook | |
| 6,830,316 | B2 | 12/2004 | Silverbrook | |
| 2003/0098899 | A1 * | 5/2003 | Jung et al. | 347/54 |
| 2007/0280722 | A1 * | 12/2007 | Katada et al. | 399/94 |
| 2014/0022307 | A1 | 1/2014 | Gao et al. | |

OTHER PUBLICATIONS

File History for U.S. Appl. No. 13/714,365

* cited by examiner

*Primary Examiner* — Stephen Meier
*Assistant Examiner* — Alexander D Shenderov
(74) *Attorney, Agent, or Firm* — Hollingsworth Davis, LLC

(57) ABSTRACT

Approaches to remove bubbles from ink in an ink jet printer are described. Bubble removal may be implemented using at least one temperature dependent element disposed along an ink flow path. The temperature dependent element is configured to change shape responsive to a change in ink temperature. The change in shape causes a volumetric change in a portion of the ink flow channel.

18 Claims, 9 Drawing Sheets

TEMPERATURE DEPENDENT SHAPE ELEMENTS FOR VOID CONTROL IN INK JET PRINTERS

FIELD

The present disclosure relates generally to methods and devices useful for ink jet printing.

SUMMARY

Embodiments discussed in the disclosure are directed to methods and devices used in ink jet printing.

Some embodiments involve a subassembly for an inkjet printer. The subassembly has an ink flow path that includes at least one temperature dependent element configured to change shape responsive to a change in ink temperature. The change in shape causes a volumetric change in a portion of the ink flow channel.

According to various aspects, the temperature dependent element comprises a bimetallic membrane. The temperature dependent element may include a shape memory alloy or shape memory polymer. According to various implementations, the temperature dependent element is configured to change shape during a time that the ink transitions between liquid phase and solid phase. In some embodiments, the temperature dependent element is configured to apply pressure to the ink during a time that the ink transitions between liquid and solid phase.

In some cases, the subassembly includes an ink flow path that includes at least one deformable surface disposed in a portion of the ink flow path, the deformable surface comprising a shape memory material configured to change shape responsive to a change in ink temperature.

According to various aspects, the deformable surface is configured to deform from a predetermined initial configuration to a second configuration during transition of the ink from liquid phase to solid phase. The deformation decreases a volume of the portion of the ink flow path. The deformable surface is configured to maintain the second configuration until reaching a transformation temperature of the shape memory material at which the deformable surface resumes the initial configuration.

In some cases, the deformable surface is configured to flexibly deform to follow ink shrinkage during the transition of the ink in the portion of the ink flow channel from liquid phase to solid phase. The second configuration substantially conforms to a shape of the ink in solid phase. The deformable surface may exert pressure on the ink while the ink is in transition from solid phase to liquid phase when the deformable surface deforms to the second configuration. According to various aspects, the transformation temperature is about equal to a mushy zone temperature of the ink. In some cases, the second configuration is a predetermined shape and the deformable surface is programmed to transition to the second configuration from the initial configuration at a second transformation temperature of the memory shape material.

According to various embodiments, the shape memory material comprises a metallic alloy. In some cases, the shape memory material comprises a polymer. the deformable surface may be configured to transition to the second configuration gradually during a transition of the ink from the liquid phase to the solid phase and the deformable surface applies pressure on the ink as the ink shrinks during transition of the ink from liquid phase to solid phase.

Some embodiments involve a method that includes flowing a phase change ink through a portion of an ink flow path. A volume of a portion of the ink flow path is decreased in response to a transition of the ink from liquid phase to solid phase using a shape memory material.

According to various aspects, decreasing the volume includes deforming a deformable surface comprising the shape memory material. The deformable surface is disposed in the portion of the ink flow path. The deformable surface configured to deform from an initial predetermined configuration to a second configuration during transition of the ink from liquid phase to solid phase.

According to various embodiments, a decreased volume of the portion of the ink flow path is maintained while temperature of the shape memory material is less than a transformation temperature. The volume of the portion of the ink flow path may be increased in response to a transition of the ink from solid phase to liquid phase. The increase in volume is caused by the deformable surface returning to the initial configuration in response to the shape memory material reaching a transformation temperature. In some cases, maintaining the decreased volume further comprises applying pressure to the ink during a transition from solid phase to liquid phase. The pressure is applied to the ink by the deformable surface which maintains the second configuration prior to the shape memory material reaching the transformation temperature.

According to various aspects, the deformable surface is deformed by flexibly conforming to a shape of the ink to achieve the second configuration during the transition of the ink from solid phase to liquid phase without applying substantial pressure to the ink during the transition from solid phase to liquid phase. In some cases, decreasing the volume comprises applying pressure to the ink during the transition from liquid phase to solid phase, the pressure applied to the ink by the deformation surface transitioning to a predetermined second configuration in response to the shape memory material reaching a second transformation temperature.

The above summary is not intended to describe each embodiment or every implementation. A more complete understanding will become apparent and appreciated by referring to the following detailed description and claims in conjunction with the accompanying drawings.

DESCRIPTION OF VARIOUS EMBODIMENTS

Figure 1:
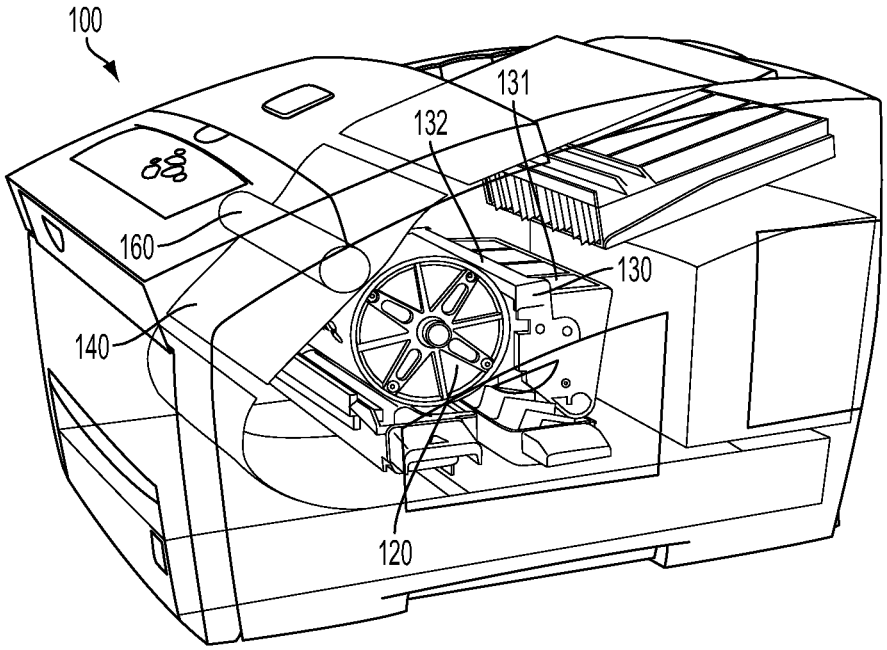
FIGS. 1 and 2 provide internal views of portions of an ink jet printer that incorporates void and bubble reduction features.

Ink jet printers operate by ejecting small droplets of liquid ink onto print media according to a predetermined pattern.

Some printers use phase-change ink which is solid at room temperature and is melted before being jetted onto the print media surface. Phase-change inks that are solid at room temperature advantageously allow the ink to be transported and loaded into the ink jet printer in solid form, without the packaging or cartridges typically used for liquid inks. In some implementations, the solid ink is melted in a page-width print head which jets the molten ink in a page-width pattern onto an intermediate drum. The pattern on the intermediate drum is transferred onto paper through a pressure nip.

In the liquid state, ink may contain bubbles that can obstruct the passages of the ink jet pathways. Air bubbles can form in solid ink printers due to the freeze-melt cycles of the ink that occur as the ink freezes when the printer is powered down and melts when the printer is powered up for use. As the ink freezes to a solid, it contracts, forming voids in the ink that can be subsequently filled by air. When the solid ink melts prior to ink jetting, the air in the voids can become bubbles in the liquid ink.

Embodiments described in this disclosure involve the use of structures that change shape as a function of temperature to reduce voids and the subsequent bubbles that are generated in phase-change ink, referred to herein as temperature dependent shape elements. The temperature dependent shape elements change shape to cause a volumetric change in a portion of an ink flow passage as the ink transitions between the liquid phase. The volumetric change inhibits the formation of bubbles in the ink during the phase transition. In some implementations discussed below, the temperature dependent memory elements comprise shape memory alloys or shape memory polymers. In some embodiments, the temperature dependent shape memory elements comprise dual material elements such as bimetallic membranes.

Shape memory alloys (SMAs) can comprise copper-aluminum-nickel, and nickel-titanium (Nitinol) alloys or various other alloys such as zinc, copper, gold and iron. The temperature dependence of shape memory alloys can arise from a transformation between the austenite form to martensite form of the alloy. The temperature dependence of shape memory polymers (SMPs) arises by a different mechanism than the austenite/martensite transformation. In contrast to SMAs, the temperature dependence of SMPs can arise, for example, due to cross links and switching segments of the polymer material which are activated by temperature.

The shape memory materials (SMAs and SMPs) have the ability to remember a particular shape even after they have been deformed into another configuration. According to various embodiments, shape memory materials are thermally-actuated and can be deformed from an initial shape and will hold the deformed shape while their temperature remains below a transformation temperature. When the temperature goes above a transformation temperature, the shape memory material will revert to the remembered shape. In some cases, the shape memory material will revert to the remembered shape once the temperature drops below a transformation temperature. According to some aspects, the transformation temperature of a shape memory material is a range of temperatures such that when the temperature is within the range of temperatures, the shape memory material will be in the remembered shape. According to various aspects, shape memory material can have more than one transformation temperature. In some cases, different transformation temperatures cause the shape memory material to revert to different shapes.

Shape memory alloys such as Nitinol, are metallic alloys which undergo a transformation between crystal structures near a transformation temperature, leading to a shape memory effect with a large attainable recovery force, which is the force that the shape memory material can apply as it returns to a remembered shape. Shape memory alloys can exhibit transformation temperatures from −10° C. to 90° C. and with thermal hysteresis from 15-120° C. meaning that their properties can be tuned, for example, to match the melting and/or mushy-zone temperatures of solid ink. Shape memory polymers (SMPs), on the other hand, are distinguished by their ability to undergo large deformations and return to their original shape with small recovery forces. SMPs are available with transformation temperatures tunable between −30° C. to 260° C.

In some embodiments, multiple membranes having different coefficients of thermal expansion can be arranged to form temperature dependent shape elements. The multiple membranes these multiple membrane elements need not be SMAs or SMPs as described above. The temperature dependent change in shape arises due to differences in the coefficient of thermal expansion of the membranes. While materials other than metals can be used for these multiple membrane structures, the examples provided herein are directed to two metallic membranes—which are denoted bimetallic membranes. In some cases, bimetallic membranes gradually deflect over a temperature range. According to various embodiments, bimetallic membranes can operate linearly or gradually over a temperature range to change the pressure of a passage or chamber.

Figure 2:
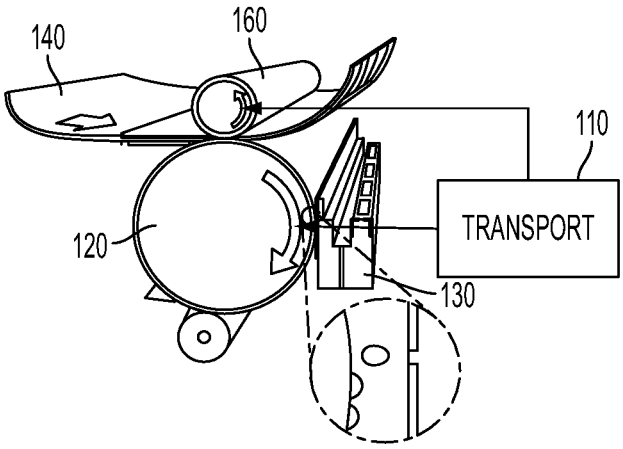

FIGS. 1 and 2 provide internal views of portions of an ink jet printer 100 that incorporates temperature dependent shape elements as discussed herein. The printer 100 includes a transport mechanism 110 that is configured to move the drum 120 relative to the print head assembly 130 and to move the paper 140 relative to the drum 120. The print head assembly 130 may extend fully or partially along the length of the drum 120 and may include, for example, one or more ink reservoirs 131, e.g., a reservoir for each color, and a print head 132 that includes a number of ink jets. As the drum 120 is rotated by the transport mechanism 110, ink jets of the print head 132 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
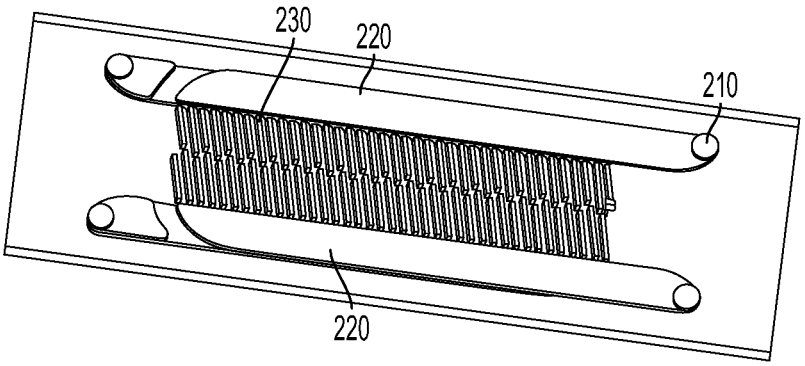
FIGS. 3 and 4 show views of an exemplary print head.
Figure 4:
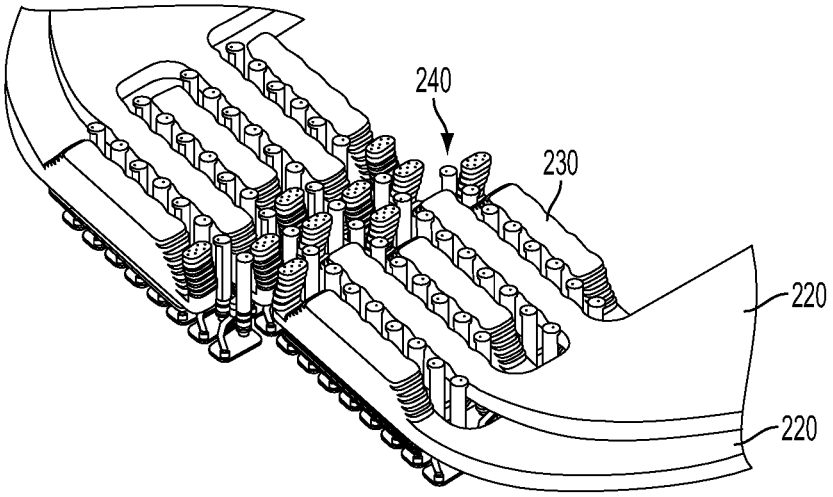

FIGS. 3 and 4 show more detailed views of an exemplary print head assembly. The path of molten ink, contained initially in the reservoir 131 (FIG. 2), flows through a port 210 into a main manifold 220 of the print head. As best seen in FIG. 4, in some cases, there are four main manifolds 220 which are overlaid, one manifold 220 per ink color, and each of these manifolds 220 connects to interwoven finger manifolds 230. The ink passes through the finger manifolds 230 and then into the ink jets 240. The manifold and ink jet geometry illustrated in FIG. 4 is repeated in the direction of the arrow to achieve a desired print head length, e.g. the full width of the drum. In some cases, the print head uses piezoelectric transducers (PZTs) for ink droplet ejection, although other methods of ink droplet ejection are known and such printers may also use the void and bubble reduction approaches described herein.

Figure 5:
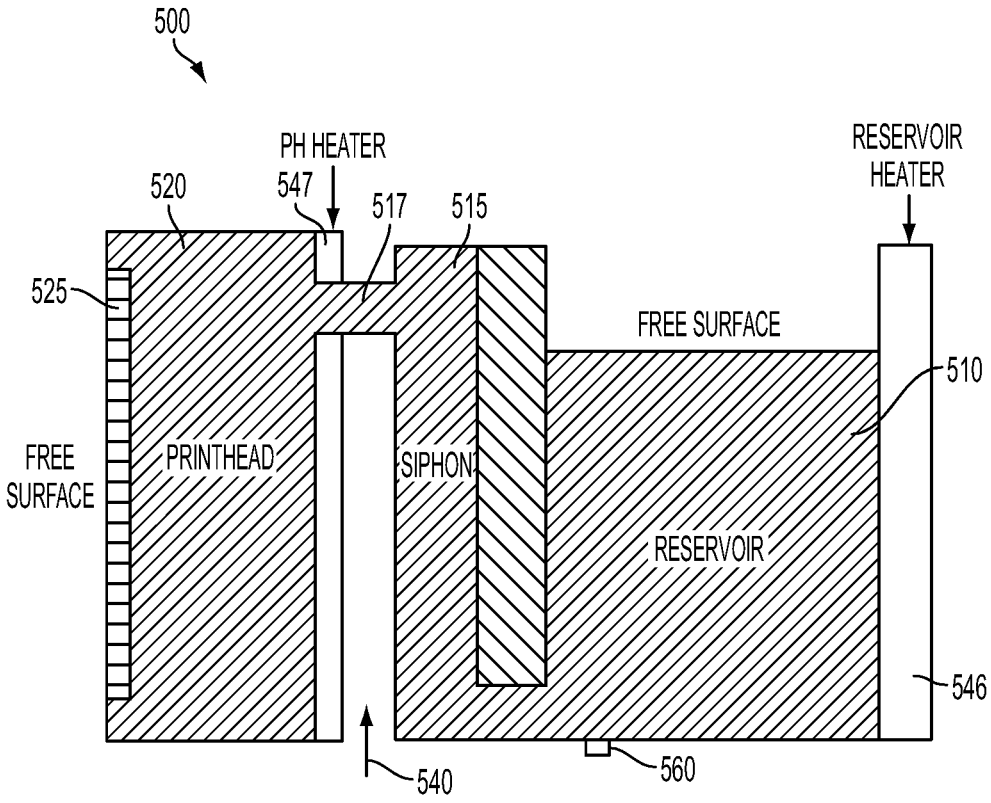
FIG. 5 is a diagram that illustrates a print head assembly that incorporates approaches for reducing voids and bubbles in the ink flow path.

FIG. 5 is a cross sectional view of an exemplary print head assembly 500 that can incorporate shape memory materials to reduce bubbles. The print head assembly 500 includes an ink reservoir 510 configured to contain a phase-change ink. The reservoir is fluidically coupled to a print head 520 that includes a jet stack. The jet stack may include manifolds and ink jets as previously discussed. In the print head assembly 500 illustrated in FIG. 5, the ink flow path is the fluidic path of the ink that is defined by various components of the print head assembly 500, such as the reservoir 510, siphon 515, print head inlet passage 517 and print head 520. The print head includes a jet stack 525 and the ink flow path within the print head 520 includes the jet stack 525, e.g., main manifolds, finger manifolds, and ink jets as illustrated in FIGS. 3 and 4. The ink flow path traverses the reservoir 510, through the siphon 515, through the print head inlet passage 517, through print head 520, through the jet stack 525 to the print head. One or more fluidic structures that form the ink flow path in the print head assembly 500 may be separated from one another by an air gap 540 or other insulator to achieve some amount of thermal decoupling between the fluidic structures.

The print head assembly 500 includes one or more thermal elements 546, 547 that are configured to heat and/or cool the ink along the ink flow path. As depicted in FIG. 5, a first thermal element 546 may be positioned on or near the reservoir 510 and a second thermal element 547 may be positioned on or near the print head 520. The thermal elements 546,-547 may be active thermal elements, e.g., units that actively add heat or actively cool the ink flow path, and/or may be passive thermal elements, e.g., passive heat sinks, passive heat pipes, etc. In some implementations, the thermal elements 546-547 may be activated, deactivated, and/or otherwise controlled by a control unit. The control unit may comprise, for example, a microprocessor-based circuit unit and/or a programmable logic array circuit or other circuit elements. In some implementations, the control unit may comprise a control unit configured to control temperature and pressure applied to the ink flow path during a bubble removal operation of the print head assembly. Bubble removal, also referred to as purging, may occur at start up, shut down, or at any other time during operation of the printer. The shape memory materials discussed herein can be incorporated anywhere in the ink flow path.

Optionally, the print head assembly 500 may include one or more temperature sensors 560 positioned along the ink flow path or elsewhere on the print head assembly 500. The temperature sensors 560 are capable of sensing temperature of the ink (or components that form the ink flow path) and generating electrical signals modulated by the sensed temperature. In some cases, the control unit 550 uses the sensor signals to generate feedback signals to the thermal units 546-547 to control the operation of the thermal units 545-547.

When phase change ink, which contains a mixture of components, is freezing along an ink flow path, there is typically a mushy zone that spans some temperature range between fully molten and fully solid ink in which only some of the mixture components are frozen. In some cases, the transformation temperature of the shape memory material is about equal to the mushy zone temperature of the ink. The thermal elements and controller referred to above can be operated to control the freezing and thawing of the ink in portions of the ink flow path where shape memory materials are positioned. Temperature dependent shape elements, such as shape memory materials and/or bi-metallic membranes, can be used in conjunction with controlled freezing and/or melting of the ink can reduce void formation.

Figure 6A:
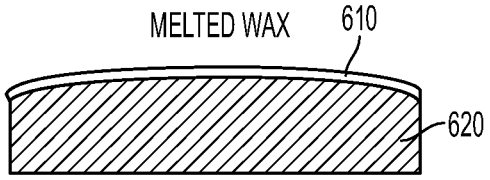
FIGS. 6A-6C show ink and the surface of a cavity at different temperatures.
Figure 6B:
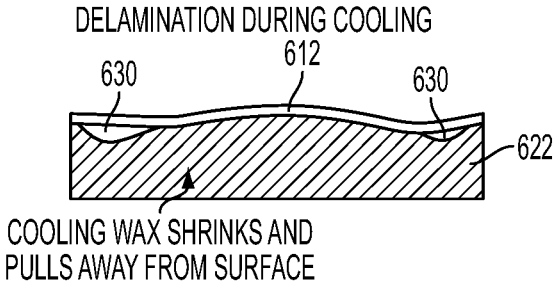
Figure 6C:
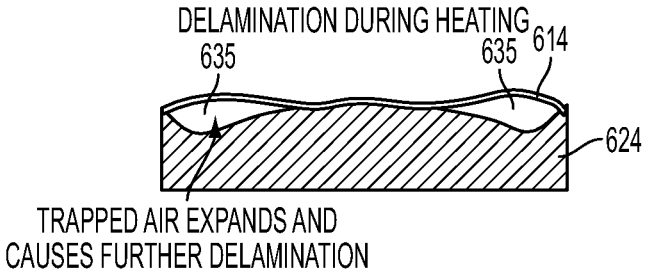

Some embodiments described herein involve using shape memory materials to reduce the void formation mechanism driven by the delamination of the ink from the surface of a cavity within the print head, and/or other locations along the ink flow path of an ink jet printer. The void formation mechanism is shown in FIGS. 6A-6C. In FIG. 6A, molten ink 620 fills the cavity and is in contact with the deformable surface of the cavity 610. In some cases the surface of the cavity 610 may be made of kapton, for example, which is not a shape memory material. As the ink 622 cools and solidifies, the thermal stresses overcome the adhesion force of the ink 622 to the surface of the cavity 612, leading to the entrainment of small air pockets 630 in the cavity between the ink 622 and the cavity surface 612 as shown in FIG. 6B. When the ink 624 is later reheated, before it begins to melt, the increasing cavity temperature causes an expansion of the gas in the cavity, causing further delamination of the cavity surface from the ink 524, and increasing the volume of air in the air pockets (voids) 635 existing in the cavity as shown in FIG. 6C. These trapped air pockets 635 become bubbles when the ink melts.

According to various embodiments, a shape memory material is used to form a portion of a cavity wall along the ink flow path. The deformable cavity wall will accommodate the shrinkage of the ink in a manner which conforms to the ink surface as it moves, leading to a reduction in the size of air pockets in the cavity. Reducing the size of air pockets (voids) in the cavity reduces the size and number of bubbles which appear when the ink melts.

Figure 7A:
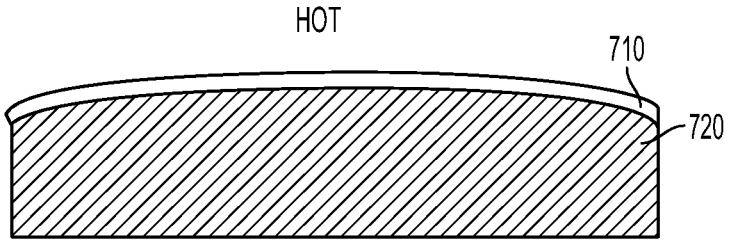
FIGS. 7A-7B illustrate ink and the surface of a cavity containing a shape memory material at different temperatures.
Figure 7B:
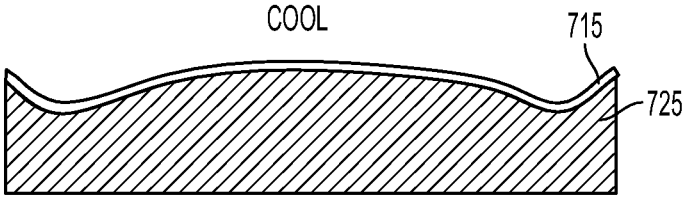

Ink exhibits good adhesion to surfaces at temperatures greater an adhesion temperature, e.g. about 50° C. FIG. 7A shows the ink 720 and surface of the cavity 710 at a temperature greater than the adhesion temperature. Once the ink cools below the adhesion temperature, the adhesion force between the ink and the surface of the cavity diminishes, leading to the delamination of the ink from the surface of the cavity. A shape memory material can be incorporated into the wall of the cavity. The shape memory material would deform with the ink as it cools, due to the adhesion forces exerted on the shape memory material by the ink. Even when the ink 725 delaminates from the surface of the cavity containing the shape memory material 715, the shape memory material would maintain the deformed shape, as depicted in FIG. 7B. As the ink 720 heats up, expands, and melts, the surface of the cavity containing the shape memory material 710 would reach its transformation temperature and return to its original flexible shape. According to some embodiments, the shape memory material gradually returns to its original shape.

Figure 8A:
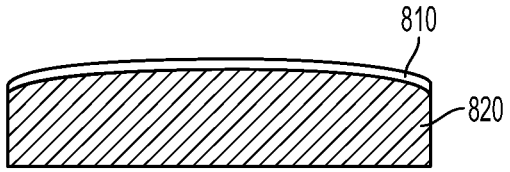
FIGS. 8A-8C provide ink and the surface of a cavity containing a shape memory material at different temperatures.
Figure 8B:
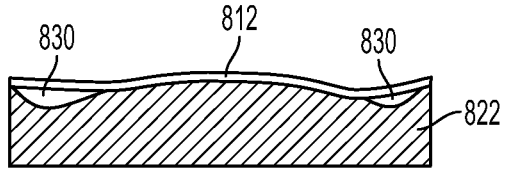
Figure 8C:
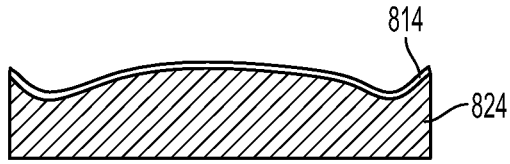

Some implementations involving shape memory materials for void prevention include shape memory composites that can remember multiple states due to the combined effect of shape memory characteristics and superelasticity of shape memory alloys. These materials can be configured to have a recovery force during cooling. The recovery force on the order of several PSI could be used to push air bubbles from the cavities after delamination has occurred, as depicted in FIGS. 8A-8C. Using shape memory materials in this manner provides a passive, thermally-controlled bubble prevention technique, which can be used in ink jet printer geometries to eliminate or reduce purge mass. In many cases, the use of shape memory materials requires no additional controls, as the actuation of the feature depends on the temperature of the ink, which is also the driving force for the delamination and subsequent bubble formation in the print head.

Turning now to FIG. 8A, molten ink 820 in contact with the surface of the cavity containing a shape memory material 810 is shown. The shape memory material is above its transformation temperature and is deformed to conform to the ink geometry. FIG. 8B illustrates air gaps 830 that are formed as the ink 822 shrinks and delaminates from the surface of the cavity containing the shape memory material 812. FIG. 8C shows the surface of the cavity containing the shape memory material 814 as it cools to its transformation temperature, thereby recovering its programmed shape and expelling air due to the recovery force that the shape memory material exerts on the ink as it cools.

Figure 9:
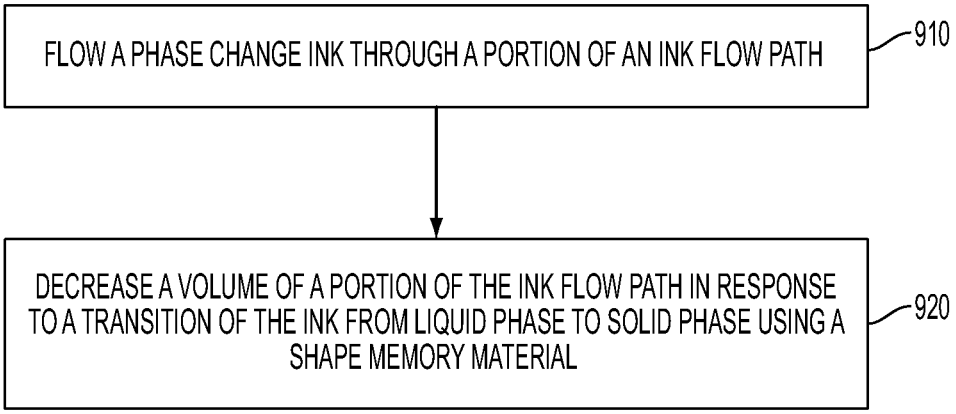
FIG. 9 is a flow diagram that describes a process that uses a shape memory material in a phase change ink system.

FIG. 9 is a flow diagram that describes a process that uses a shape memory material in a phase change ink system. According to FIG. 9, a phase change ink flows 910 through a portion of an ink flow path. A volume of a portion of the ink flow path is decreased 920 in response to a transition of the ink from liquid phase to solid phase using a shape memory material. In some cases, decreasing 920 the volume of a portion of the ink flow path comprises deforming a surface that includes the shape memory material.

Some embodiments described herein involve the use of multiple membranes having different thermal coefficients of expansion as temperature dependent shape elements. These multiple membrane elements need not be formed of shape memory materials as described above, rather the temperature dependent change occurs due to differences in the coefficient of thermal expansion in two membranes that are fused together. The multiple membrane structures are referred to herein as bimetallic membranes, although more than two membranes may be used to form a multiple membrane element and/or the component membranes need not be metallic. The coefficient of thermal expansion of a membrane describes the fractional change in size per degree change in temperature of the membrane. When membranes having different thermal coefficients of expansion are fused or bonded together in a dual (or multiple) membrane structure, one membrane of the duel membrane structure expands more with temperature than the other membrane causing the dual membrane structure to change shape as a function of temperature.

Figure 10:
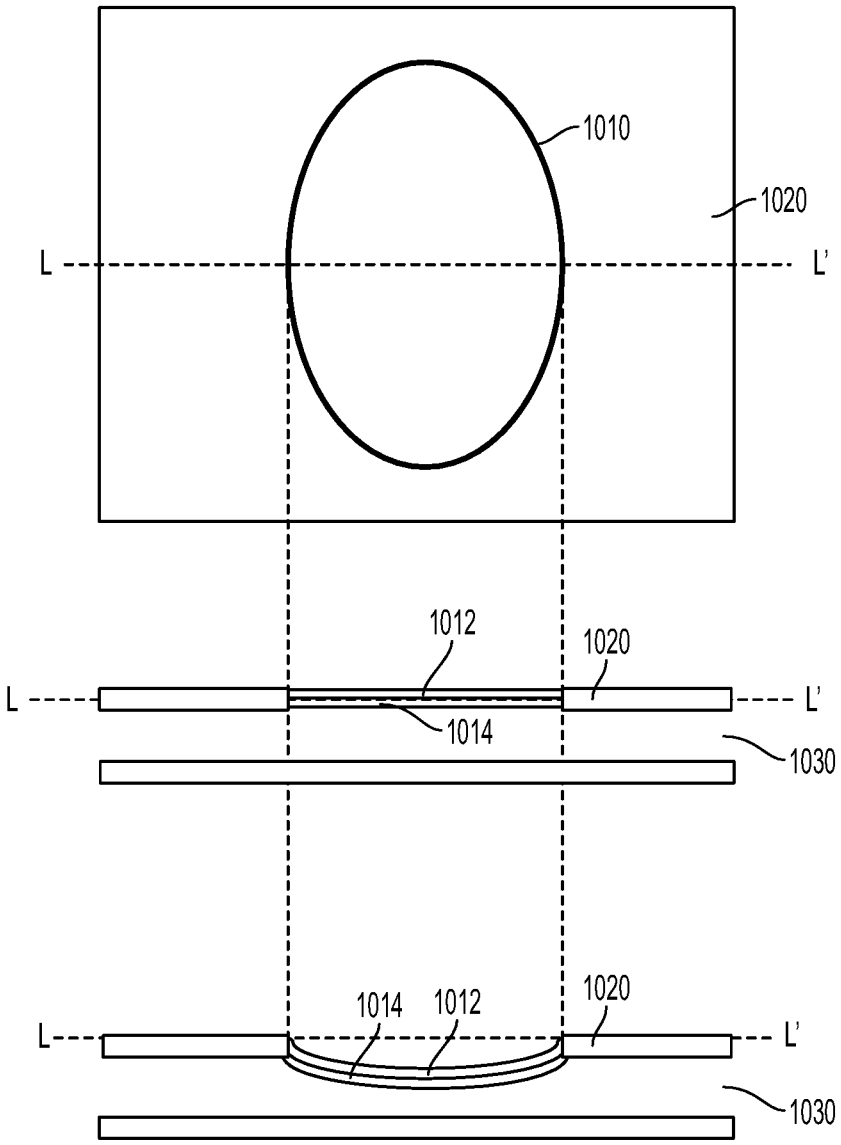
FIG. 10 illustrates operation of a dual membrane shape change element disposed along an ink flow path of an ink jet printer.

FIG. 10 shows an example of a bimetallic membrane 1010 disposed along an ink flow path 1030. The upper portion of FIG. 10 is a top view of the bimetallic membrane 1010 disposed along a portion of a structure 1020 that forms the ink flow path 1030. The bimetallic membrane includes a first membrane 1012, having thermal coefficient of expansion, $\alpha_1$, and a second membrane 1014, having thermal coefficient of expansion, $\alpha_2$, where $\alpha_1 \neq \alpha_2$. The bimetallic membrane 1010 is in an undeflected state in the cross section through L-L' shown in the middle portion of FIG. 10. As the temperature of the ink changes, the first membrane 1012 expands more than the second membrane 1014. The cross section through L-L' shown at the lower portion of FIG. 10 shows the bimetallic membrane 1010 deflecting into the ink flow path 1030 and causing a volumetric change in the ink flow path where the bimetallic membrane is positioned.

Figure 11A:
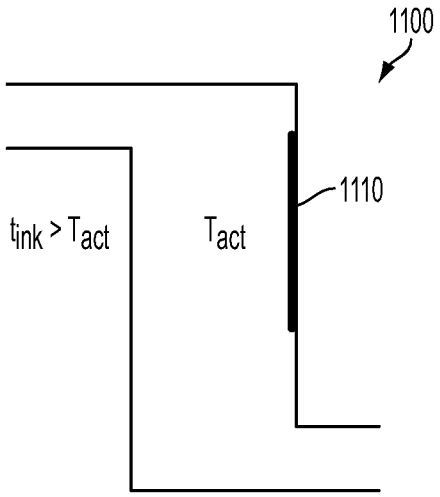
FIGS. 11A and 11B illustrate the use of a bimetallic membrane in an ink flow path.
Figure 11B:
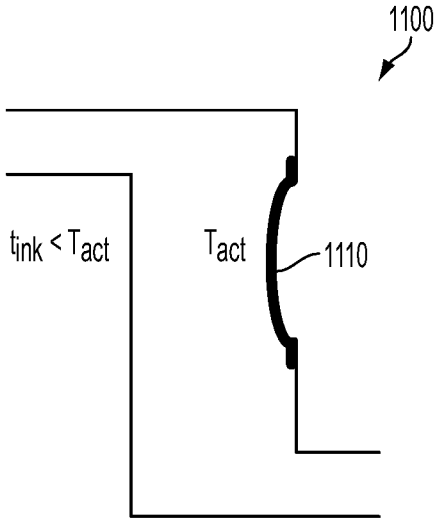

FIGS. 11A and 11B illustrate the use of a bimetallic membrane disposed along an ink flow path. FIG. 11A shows an example of an ink flow path 1100 and bimetallic membrane 1110 in an undeflected state. In the example shown in FIG. 11A, the temperature of the ink, $t_{ink}$, within the ink flow path is greater than the activation temperature, $T_{act}$, of the bimetallic membrane 1110 and thus the bimetallic membrane 1110 remains undeflected. FIG. 11B shows the ink flow path 1100 at a time that $t_{ink}$ has dropped below the $T_{act}$ of the bimetallic membrane 1110 causing the bimetallic membrane 1110 to deflect into the ink flow path. The deflection of the bimetallic membrane 1110 into the ink flow path 1100 causes a volumetric decrease of the ink flow path at the portion of the ink flow path where the bimetallic membrane is located. The $T_{act}$ of the bimetallic membrane 1110 may be selected so that the bimetallic membrane applies pressure on the ink in the ink flow path 1100 as the ink is in the mushy temperature zone of the ink phase change, e.g., as the ink changes phase from liquid to solid or solid to liquid.

Various modifications and additions can be made to the preferred embodiments discussed above. Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

What is claimed is:

1. A subassembly for an inkjet printer for phase change ink comprising an ink flow path that includes at least one temperature dependent element configured to change shape responsive to a change in ink temperature, wherein the change in ink temperature that causes the shape change occurs when the ink temperature reaches a predetermined temperature or temperature range during a time that the ink transitions between liquid phase and solid phase, the change in shape causing a volumetric change in a portion of the ink flow path.

2. The subassembly of claim 1, wherein the temperature dependent element comprises a bimetallic membrane.

3. The subassembly of claim 1, wherein the temperature dependent element comprises a shape memory alloy or shape memory polymer.

4. The subassembly of claim 1, wherein the temperature dependent element is configured to apply pressure to the ink during a time that the ink transitions between liquid and solid phase.

5. A subassembly for an inkjet printer for phase change ink, comprising an ink flow path that includes at least one deformable surface disposed in a portion of the ink flow path, the deformable surface comprising a shape memory material configured to change shape responsive to a change in ink temperature during transition of the ink from liquid phase to solid phase.

6. The subassembly of claim 5, wherein the shape memory material comprises a metallic alloy.

7. The subassembly of claim 5, wherein the shape memory material comprises a polymer.

8. The subassembly of claim 5, wherein the deformable surface is configured to change shape gradually during a transition of the ink from the liquid phase to the solid phase and the deformable surface applies pressure on the ink as the ink shrinks during transition of the ink from liquid phase to solid phase.

9. A subassembly for an inkjet printer, comprising an ink flow path that includes at least one deformable surface disposed in a portion of the ink flow path, the deformable surface comprising a shape memory material configured to change shape responsive to a change in ink temperature, wherein the deformable surface is configured to deform from a predetermined initial configuration to a second configuration during transition of the ink from liquid phase to solid phase, the deformation configured to decrease a volume of the portion of the ink flow path, the deformable surface configured to maintain the second configuration until reaching a transformation temperature of the shape memory material at which the deformable surface resumes the initial configuration.

10. The subassembly of claim 9, wherein:

the deformable surface is configured to flexibly deform to follow ink shrinkage during the transition of the ink in the portion of the ink flow path from liquid phase to solid phase; and the second configuration is configured to substantially conform to a shape of the ink in solid phase.

11. The subassembly of claim 9, wherein the deformable surface is configured to exert pressure on the ink while the ink is in transition from solid phase to liquid phase when the deformable surface deforms to the second configuration.

12. The subassembly of claim 9, wherein the transformation temperature is within a mushy zone temperature range of the ink.

13. The subassembly of claim 9, wherein the second configuration is a predetermined shape and the deformable surface is configured to transition to the second configuration from the initial configuration at a second transformation temperature of the memory shape material.

14. A method, comprising:

flowing a phase change ink through a portion of an ink flow path that includes at least one deformable surface disposed in a portion of the ink flow path, the deformable surface comprising a shape memory material configured to change shape responsive to a change in ink temperature; and decreasing a volume of a portion of the ink flow path in response to a transition of the ink from liquid phase to solid phase using the shape memory material.

15. The method of claim 14, wherein decreasing the volume comprises deforming the deformable surface, the deformable surface disposed in the portion of the ink flow path, the deformable surface configured to deform from an initial predetermined configuration to a second configuration during transition of the ink from liquid phase to solid phase.

16. The method of claim 15, further comprising: maintaining a decreased volume of the portion of the ink flow path while temperature of the shape memory material is less than a transformation temperature; and increasing the volume of the portion of the ink flow path in response to a transition of the ink from solid phase to liquid phase, the increase in volume caused by the deformable surface returning to the initial configuration in response to the shape memory material reaching the transformation temperature.

17. The method of claim 16, wherein maintaining the decreased volume further comprises applying pressure to the ink during the transition from solid phase to liquid phase, the pressure applied to the ink by the deformable surface which maintains the second configuration prior to the shape memory material reaching the transformation temperature.

18. The method of claim 15, wherein decreasing the volume comprises applying pressure to the ink during the transition from liquid phase to solid phase, the pressure applied to the ink by the deformation surface transitioning to a predetermined second configuration in response to the shape memory material reaching a second transformation temperature.

* * * * *